United States Patent [19]

Watson

[11] 4,396,118

[45] Aug. 2, 1983

[54] CONTAINER AND METHOD OF FORMING

[75] Inventor: Robert L. Watson, Mt. Vernon, Ohio

[73] Assignee: Weyerhaeuser Company, Tacoma, Wash.

[21] Appl. No.: 455,177

[22] Filed: Jan. 3, 1983

Related U.S. Application Data

[63] Continuation-in-part of Ser. No. 374,211, May 3, 1982, abandoned.

[51] Int. Cl.[3] ..... B65D 75/14; B65D 5/10

[52] U.S. Cl. ..... 206/424; 229/40; 229/492

[58] Field of Search ..... 206/424, 492; 229/40

[56] References Cited

U.S. PATENT DOCUMENTS

| | | | |
|---|---|---|---|
| Re. 25,856 | 9/1965 | Boitel | 229/40 |
| 3,211,359 | 10/1965 | Fickes | 229/40 |
| 3,289,824 | 12/1966 | Boitel | 206/424 |
| 3,325,964 | 6/1967 | Boitel | 53/494 |
| 4,215,780 | 8/1980 | Carlson | 206/434 |

*Primary Examiner*—William T. Dixson, Jr.
*Assistant Examiner*—Brenda J. Ehrardt

[57] ABSTRACT

A container which protects a book or similar product, has reinforced end walls and is easier and cheaper to form than present containers and the method of forming the container into a book package. The end protection cells of the container are attached to side reinforcing panels. This reduces the number of steps required to place reinforcing panels in the end wall construction. In the preferred construction the end cell panels are attached to the main body only through the reinforcing panels. In one construction, an additional bellows or gusset panel is provided for additional reinforcement.

46 Claims, 13 Drawing Figures

Fig. 7
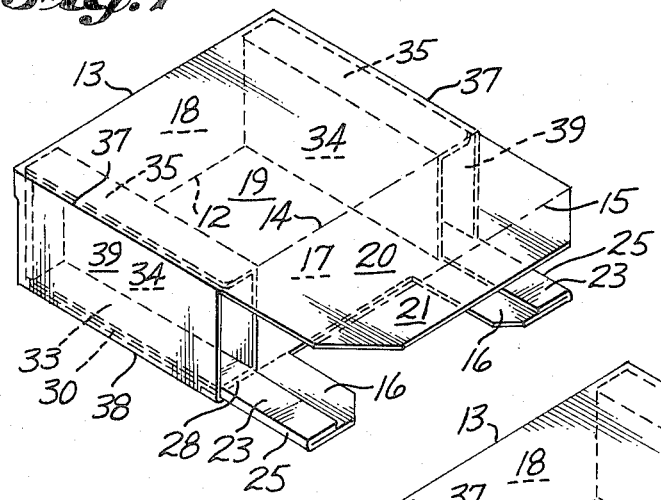
Fig. 8
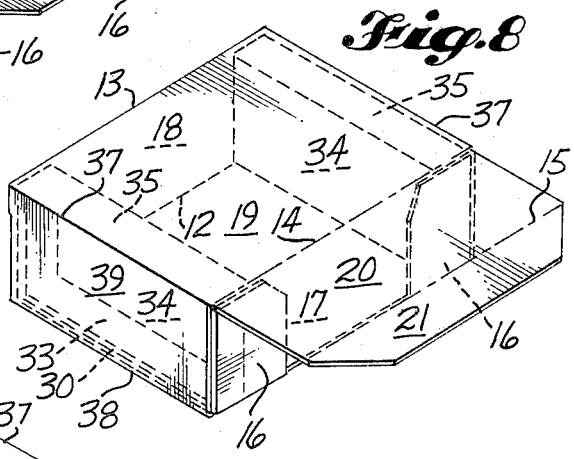
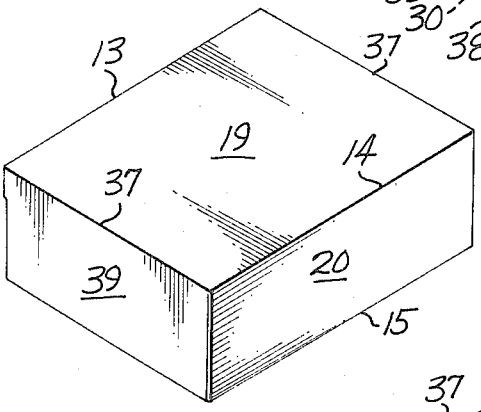
Fig. 9
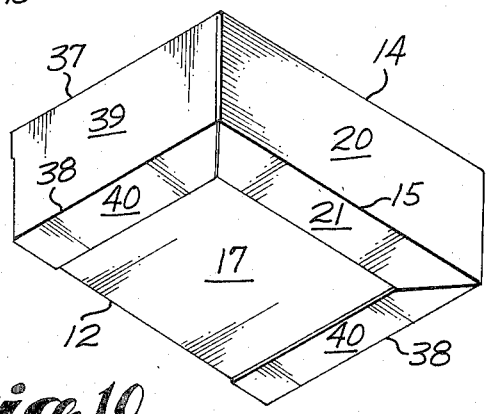
Fig. 10

Fig. 11
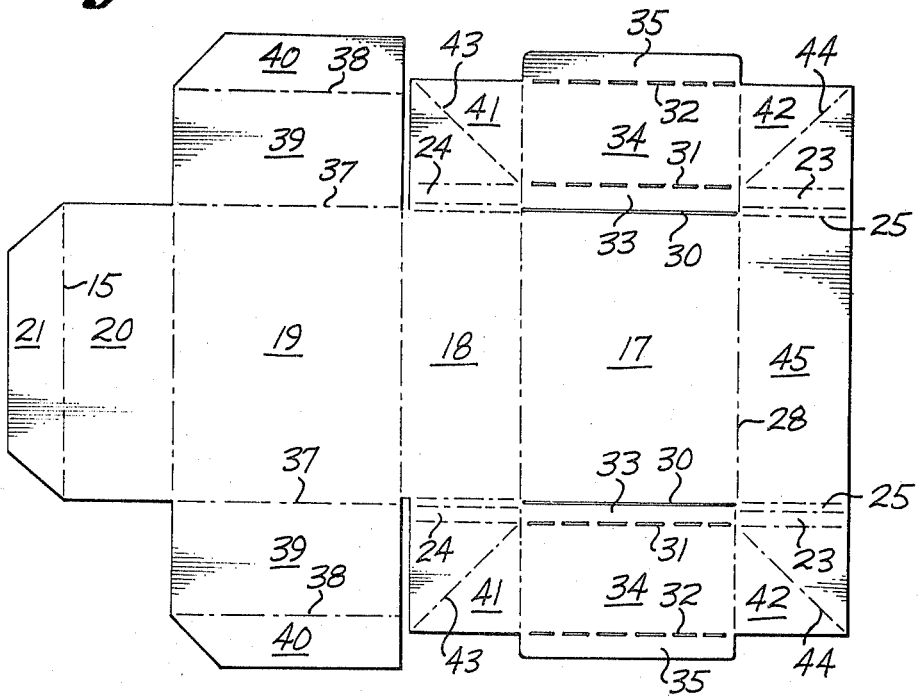
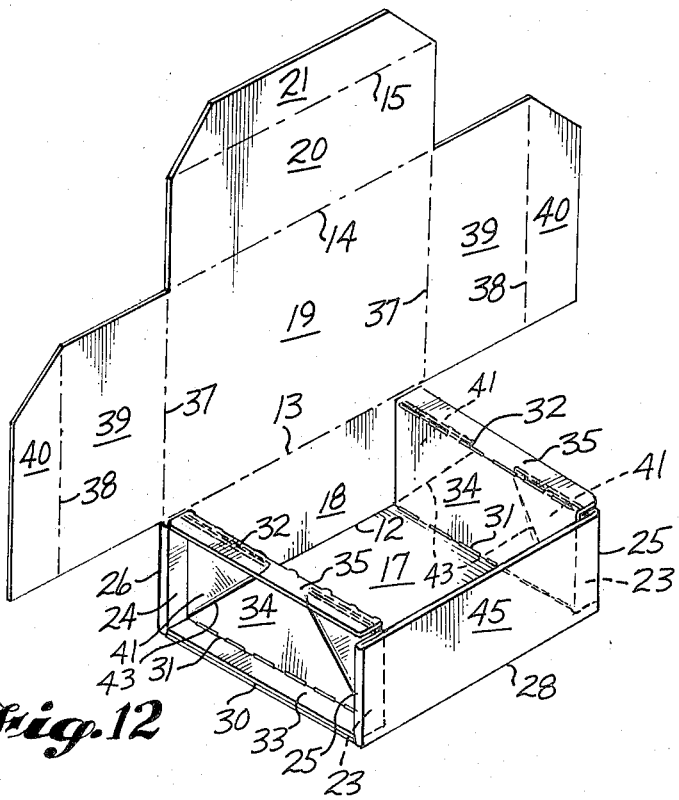
Fig. 12

CONTAINER AND METHOD OF FORMING

RELATED CASE

This is a continuation-in-part of my co-pending U.S. patent application Ser. No. 374,211 filed May 3, 1982 now abandoned.

BACKGROUND OF THE INVENTION

1. Field of the Invention

A container for packaging and protecting books and similar objects, and the method of forming the container into a package.

2. Other Art in the Field

There are many designs for book mailers. Exemplary are Boitel, U.S. Pat. No. Re. 25,856 issued Sept. 14, 1965; Boitel, U.S. Pat. No. 3,289,824 issued Dec. 6, 1966; Boitel, U.S. Pat. No. 3,325,964 issued June 20, 1967; and Carlson, U.S. Pat. No. 4,215,780 issued Aug. 8, 1980.

SUMMARY OF THE INVENTION

The purpose of the present invention is to provide a container which protects the enclosed book or similar product, has reinforced end walls, and which is easier and cheaper to form than present containers. This is done by attaching the end protection cells of the container to side reinforcing panels. This reduces the number of steps required to form the reinforced end wall construction. In the preferred construction the end cell panels are attached to the main body only through the reinforcing panels. In one construction, an additional bevel or gusset panel is provided for additional reinforcement.

BRIEF DESCRIPTION OF THE DRAWINGS

FIGS. 2–9 are isometric views showing the various steps in folding the blank into a container.

FIG. 10 is an isometric view of the bottom of the finished container.

FIG. 11 is a top plan view of a modified blank for the container.

FIG. 12 is an isometric view showing the formation of the modified container.

DESCRIPTION OF THE PREFERRED EMBODIMENTS

Figure 1:
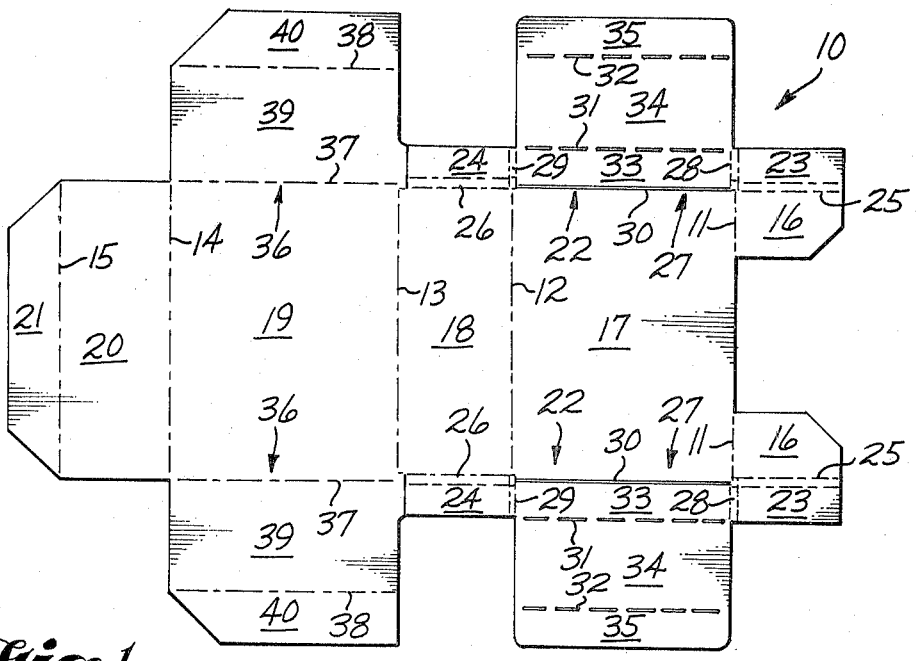
FIG. 1 is a top plan view of a blank for the container.
Figure 2:
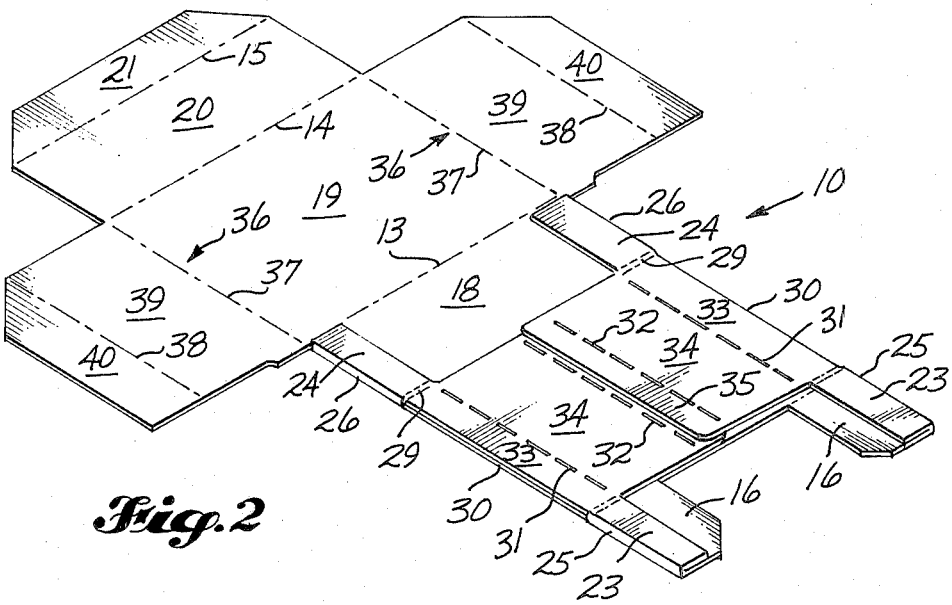
Figure 3:
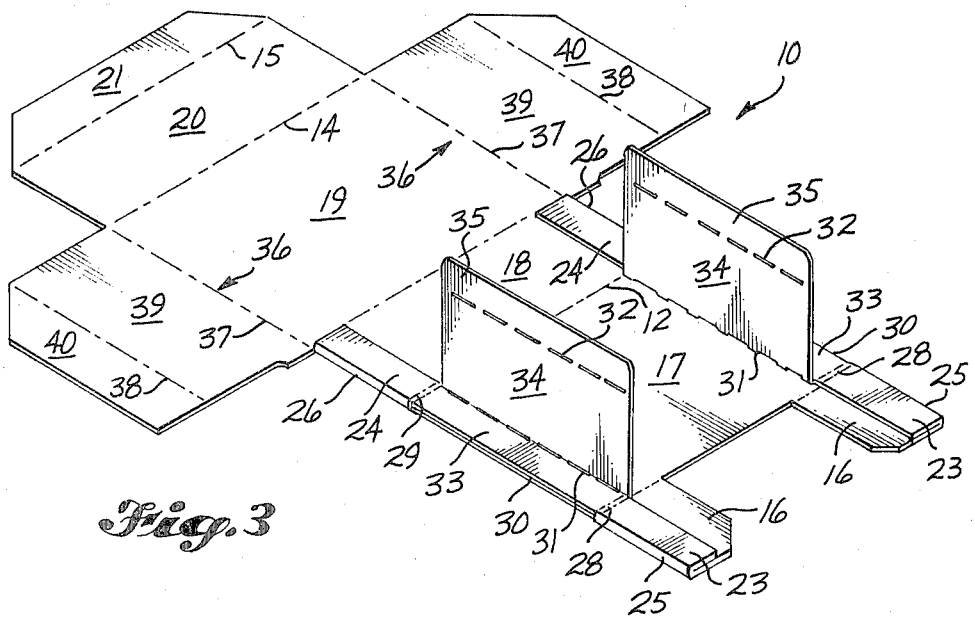
Figure 4:
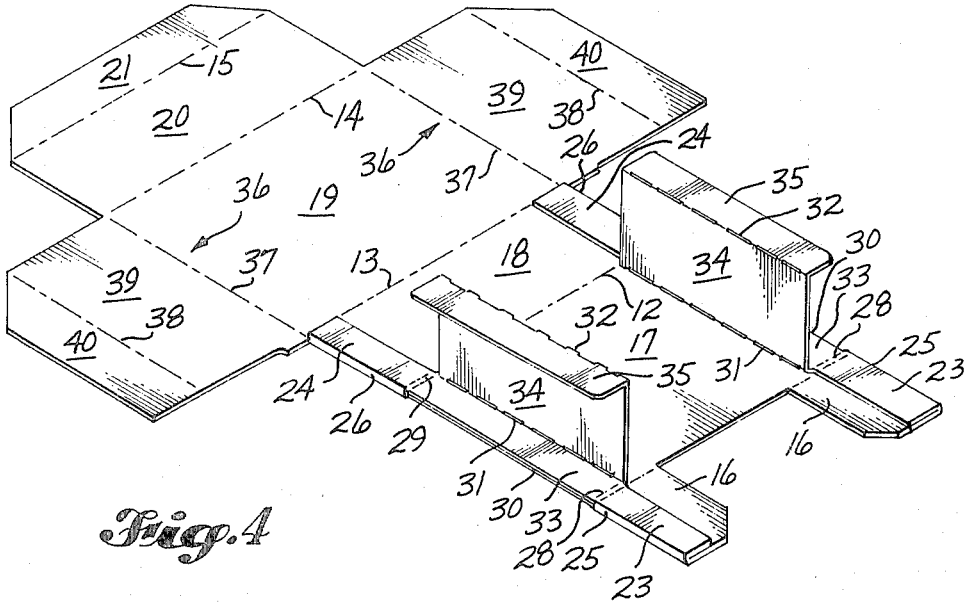
Figure 5:
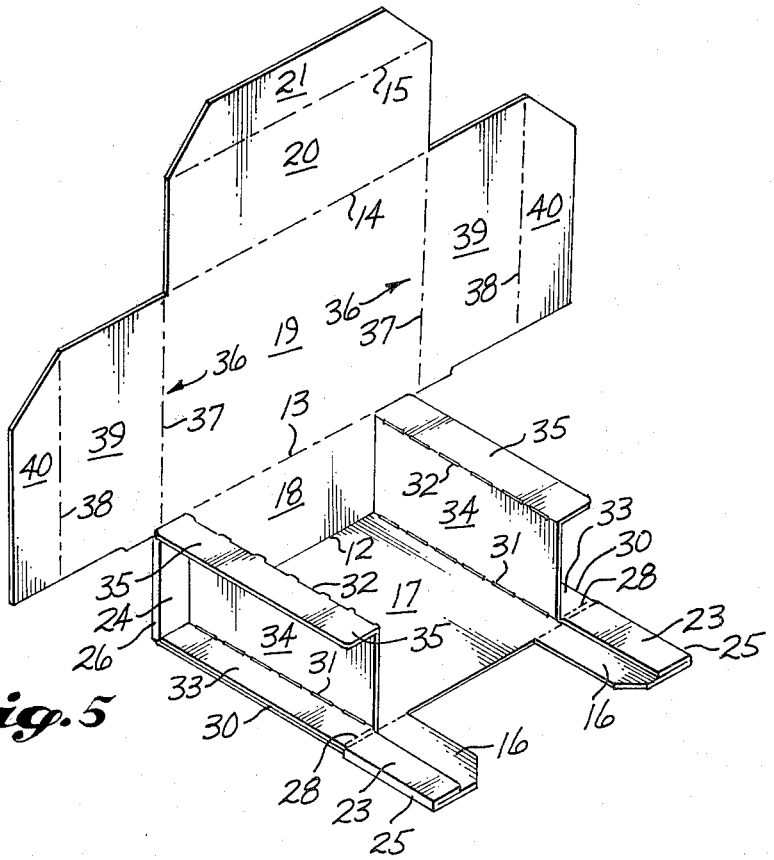
Figure 6:
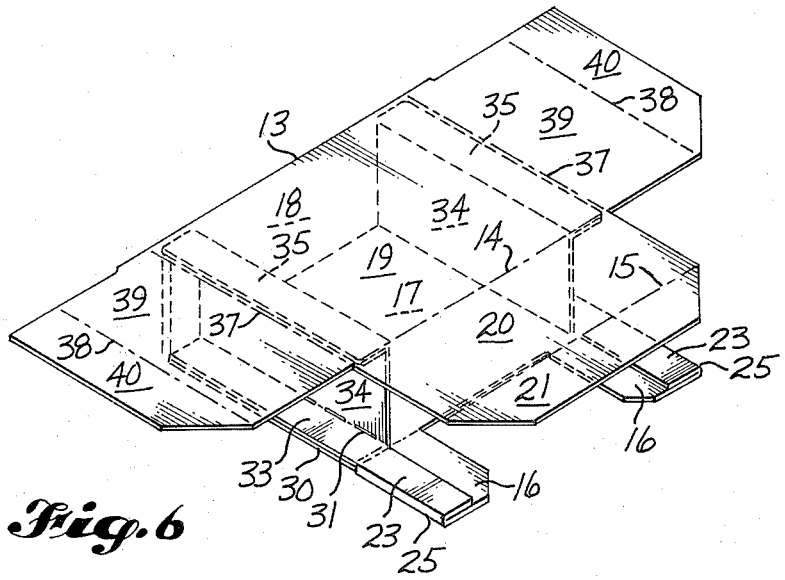

The preferred embodiments of my invention are the same as in my earlier co-pending application. Additional features disclosed in this application are the tear strip and anti-warpage score line normally used in book mailers. These features are shown in some of the above-mentioned art and in FIG. 13 of this application. The obliquely extending tension relieving score line in the reinforcing panels is also disclosed, and the slots between the side reinforcing panels and the end closure panels are emphasized.

Blank 10 is divided by score lines 11, 12, 13, 14 and 15 into a first side panel 16, a bottom panel 17, a second side panel 18, a top panel 19, a third side panel 20 and a first closure panel 21.

The first side panel 16 is shown as being divided into two spaced sections attached adjacent each end of bottom panel 17. In machinery for forming and closing the container, there is a lug that aligns the book with the container. The lug extends along the central portion of the package and is aligned with score line 11. The space between the two sections of the first side panel 16 accommodates this lug. In forming machinery that does not have this lug, the first side panel 16 could be a unitary panel.

Bottom end members 22 are at each end of the first and second side panels 16 and 18 and the bottom panel 17. These members form the reinforced end cell in the completed container. The bottom end members 22 have reinforcing panels 23 and 24 hingedly attached to the first and second side panels 16 and 18 respectively by score lines 25 and 26 respectively. Score lines 25 are aligned with score lines 26.

A central end section 27 is between these reinforcing panels and is hingedly attached to these reinforcing panels by score lines 28 and 29, score line 28 being between reinforcing panel 23 and central end section 27 and score line 29 being between reinforcing panel 24 and central end section 27. Score lines 28 and 29 are extensions of score lines 11 and 12 respectively. It is preferred that central end section 27 not be attached to bottom panel 17. Therefore, it is preferred that line 30 between central end section 27 and bottom panel 17 be a cut line as shown. However, line 30 may be a double score line aligned with score lines 25 and 26.

The central end section 27 is divided by score, or slit score, lines 31 and 32 into a lower end cell panel 33, a central end cell, or inner end, panel 34 and an upper end cell panel 35. These three panels form the end cell in the formed container. Score line 31 would be aligned with or be outwardly of the outer edges of reinforcing panels 23 and 24 so that these reinforcing panels are the only attachment for the lower end cell panel 33 along score lines 28 and 29.

Figure 13:
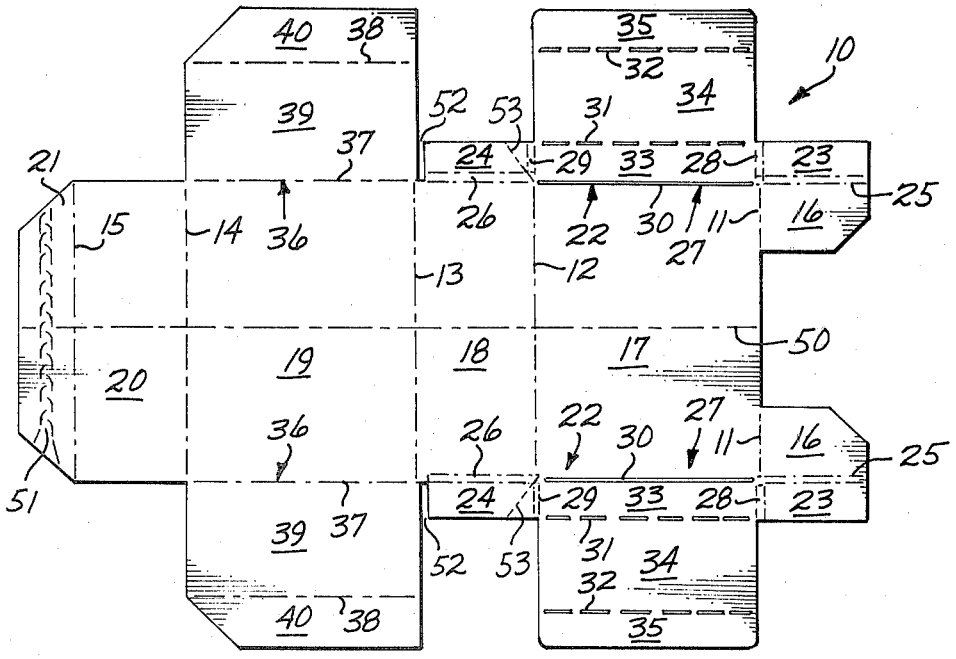
FIG. 13, is a top plan view of another modified blank for the container.

Outer end closure members 36 are attached to top panel 19 along score lines 37. The members 36 are divided by a score, or slit score, line 38 into an outer end panel 39 and a second closure panel 40. The outer end panels 39 may be separated from the reinforcing panels 24 by a slit, as shown, or usually by a slot as shown in FIGS. 11 and 13.

In forming the container, the bottom end members 22 are folded around score lines 25 and 26, and 30 if 30 is a score line, until the bottom end member 22 is contiguous with the first and second side panels 16 and 18 and the bottom panel 17. The inner end panels 34 are bent upwardly around scoreline 31 until they are substantially perpendicular with the bottom panel 17 and the upper end cell panels 35 are bent downwardly around score lines 32 until they are substantially parallel and opposite panels 33 to form the end cells of the container.

Side panel 18 and the associated reinforcing panels 24 are bent upwardly around score lines 12 and 29 until panel 18 is substantially perpendicular to bottom panel 7 and the attachment and reinforcing panels 24 are between the end cell panels 33 and 35. Panels 18, 19, 20 and 21 are bent upwardly as a unit. The book is placed on the bottom panel 17 and aligned with the package by the lug and the side panel 18. Top panel 19 is bent downwardly around score line 13 until it rests on top of the book and is parallel with bottom panel 17. The outer end closure members 36 are then bent downwardly around score line 37 and the closure panels 40 bent inwardly around score lines 38 and adhered to the outer surface of bottom panel 17. The blank would move forwardly through plows and associated apparatus which would fold these various panels into place. Initially, the panel 21 would be the leading panel in the blank's forward travel through the apparatus. This allows the panels 18, 19, 39 and 40 to be folded into place.

The wrapper now moves at right angles to its earlier travel so that the panels 16, 20 and 21 may be folded into place. Panel 16 and the associated reinforcing panels 23 are bent upwardly around score lines 11 and 28 until panel 16 is perpendicular to the bottom panel 17 and the panels 23 are between panels 33 and 35. Panel 20 is bent downwardly around score line 14 and closure panel 21 bent inwardly around score line 15 and adhered to the outer face of bottom panel 17. In one form of the container the panel 20 would be the closure panel and attach to panel 16.

FIGS. 11-12 show a modification in which bellows panels 41 and 42 are attached to reinforcing panels 24 and 23 respectively along score line 31 and to inner end panel 34 along score lines 29 and 28 respectively. Each of these bellows panels is divided by a diagonal score line extending from its inner attached corner to its outer free corner, panel 41 being divided by score line 43 and panel 42 being divided by score line 44. These would fold outwardly and be on the outer face of inner end panel 34 as the end cell is being formed. There would be a slightly different method of container formation because it is necessary in this construction to fold the inner end panel 34 and the first and second side panels 16 and 18 upwardly at the same time. These bellows panels would act as additional reinforcement but their formation require an additional operator at the forming station and additional cost of formation.

FIG. 13 illustrates four additional design features. The first two are standard design features that would normally be found in a book mailer. The first feature is the central score line 50 which relieves the board and mailer if there is a tendency for the board to warp. The score line 50 extends centrally of the main panels and prevents the mailer from warping the enclosed book. The second feature is the tear strip 51 for opening the mailer. Its location may be on a side or end panel.

The other two are specific to the present construction. The third design feature is the slot 52 between the panels 24 and 39. The panel 24 should be shorter than the side wall 18. The fourth design feature is the oblique score line 53 in the lower section of panel 24. The score line 53 extends outwardly from the corner of panel 24 defined by the second side panel 18 and the lower end wall panel 33. It acts as a tension relief for score line 29.

Otherwise FIG. 13 and FIG. 1 are the same.

The usual material of construction for these containers is double faced corrugated board. The corrugations would run in the same direction as the score lines 11–15 so that the corrugations in the inner and outer end panels 34 and 39 would extend upwardly and give additional strength to the container.

In the claims the term "score line" refers to score lines, double score lines and perforations.

I claim:

1. A blank for a container comprising
a first side panel,
a bottom panel,
a second side panel, and
a top panel hingedly attached to each other by score lines,
and a first closure panel hingedly attached to one of said first side panel and said top panel,
bottom end members extending outwardly from end edges of said first and second side panels and said bottom panel,
said bottom end members comprising
reinforcing panels hingedly attached to said end edges of said first and second side panels,
a central end section hingedly attached to said reinforcing members, said hinged attachment being score lines aligned with said score lines between said bottom panel, and said first and second side panels,
said central end section being divided by transverse score lines into
a bottom end cell panel having said hinged attachment with said reinforcing panels,
an inner end panel hingedly attached to said bottom end cell panel, said inner end panel being separated from said reinforcing panels, and
an upper end cell panel hingedly attached to said inner end panel.

2. The blank of claim 1 further comprising
end closure panels attached to said top panel, said end closure panels comprising
an outer end panel hingedly attached to said top panel, and
a second closure panel hingedly attached to the outer edge of said outer end panel.

3. The blank of claim 1 further comprising
said first closure panel is attached to said top panel by a score line along the side edge of said top panel.

4. The blank of claim 1 further comprising
a third side panel between said first closure panel and said top panel and hingedly attached to both.

5. The blank of claim 1 further comprising
bellows panels hingedly attached both to said reinforcing panels and the side edges of said inner end panel,
said bellows panels each having a diagonal score line extending from an inner corner of said bellows panel formed by both said reinforcing panel and said inner end panel, and an outer free corner of said bellows panel opposite said inner corner.

6. The blank of claim 1 in which
said reinforcing panels attached to said second side panel have oblique score lines extending across said reinforcing panel from the corner of said reinforcing panel formed by said central reinforcing section and said side wall.

7. The blank of claim 1 in which
said bottom end cell panel is separated from said bottom panel by a cut line whereby the only attachment between said bottom end members and said first and second side panels and said bottom panel is by said score lines attaching said reinforcing panels to said first and second side panels.

8. The blank of claim 7 further comprising
end closure panels attached to said top panel, said end closure panels comprising
an outer end panel hingedly attached to said top panel, and
a second closure panel hingedly attached to the outer edge of said outer end panel.

9. The blank of claim 7 further comprising
said first closure panel is attached to said top panel by a score line along the side edge of said top panel.

10. The blank of claim 7 further comprising
a third side panel between said first closure panel and said top panel and hingedly attached to both.

11. The blank of claim 7 further comprising
bellows panels hingedly attached both to said reinforcing panels and the side edges of said inner end panel,
said bellows panels each having a diagonal score line extending from an inner corner of said bellows panel formed by both said reinforcing panel and said inner end panel, and an outer free corner of said bellows panel opposite said inner corner.

12. The blank of claim 7 in which
said reinforcing panels attached to said second side panels have oblique score lines extending across said reinforcing panel from the corner of said reinforcing panel formed by said central reinforcing section and said side wall.

13. A container comprising
a first side panel,
a bottom panel,
a second side panel, and
a top panel hingedly attached to each other by score lines
and a first closure panel hingedly attached to one of said first side panel and said top panel,
reinforced end cells in the ends of said container,
said end cells comprising
reinforcing panels hingedly attached to the end edges of said first and second side panels, said reinforcing panels extending into said container,
a bottom end cell panel hingedly attached to each pair of said reinforcing panels and extending along the end edge of said bottom panel,
an inner end panel hingedly attached to said bottom end cell panel, said inner end panel being separated from said reinforcing panels, and extending between said bottom and said top panels, and
an upper end cell panel hingedly attached to said inner end panel and extending outwardly of said inner end panel and along the end edge of said top panel, and
said first closure panel closing said container.

14. The container of claim 13 further comprising
end closure panels attached to said top panel, said end closure panels comprising
an outer end panel hingedly attached to said top panel and extending between said top and bottom panels, and
a second closure panel hingedly attached to the outer edge of said outer end panel and attached to said bottom panel.

15. The container of claim 14 further comprising
bellows panels extending along the outer face of said inner end panels, and
each of said bellows panels being hingedly attached both to said reinforcing panel and a side edge of said inner end panel, and having a diagonal score line extending from its inner corner adjacent both said reinforcing panel and said inner end panel, and its outer free corner opposite said inner corner.

16. The container of claim 13 in which
said first closure panel is hingedly attached to said top panel by a score line along the side edge of said top panel and
said closure panel is attached to said first side wall.

17. The container of claim 13 further comprising
a third side panel between said first closure panel and said top panel and hingedly attached to both, and
said first closure panel fastened to said bottom panel.

18. The container of claim 13 in which
said reinforcing panels attached to said second side panels have oblique score lines extending across said reinforcing panel from the corner of said reinforcing panel formed by said central reinforcing section and said side wall.

19. The container of claim 13 in which
said bottom end cell panel is separated from said bottom panel by a cut line.

20. The container of claim 19 further comprising
end closure panels attached to said top panel, said end closure panels comprising
an outer end panel hingedly attached to said top panel and extending between said top and bottom panels, and
a second closure panel hingedly attached to the outer edge of said outer end panel and attached to said bottom panel.

21. The container of claim 20 further comprising
bellows panels extend along the outer face of said inner end panels, and
each of said bellows panels being hingedly attached both to said reinforcing panel and a side edge of said inner end panel, and having a diagonal score line extending from its inner corner adjacent both said reinforcing panel and said inner end panel, and its outer free corner opposite said inner corner.

22. The container of claim 19 in which
said first closure panel is hingedly attached to said top panel by a score line along the side edge of said top panel and
said closure panel is attached to said first side wall.

23. The container of claim 19 further comprising
a third side panel between said first closure panel and said top panel and hingedly attached to both, and
said first closure panel fastened to said bottom panel.

24. The container of claim 19 in which
said reinforcing panels attached to said second side panel have oblique score lines extending across said reinforcing panel from the corner of said reinforcing panel formed by said central reinforcing section and said side wall.

25. The container of claim 13 further comprising
a book within and tightly held by
said first and second side panels,
said bottom panel,
said top panel and
said inner end panels.

26. The container of claim 25 further comprising
end closure panels attached to said top panel, said end closure panels comprising
an outer end panel hingedly attached to said top panel and extending between said top and bottom panels, and
a second closure panel hingedly attached to the outer edge of said outer end panel and attached to said bottom panel.

27. The container of claim 26 further comprising
bellows panels extend along the outer face of said inner end panels, and
each of said bellows panels being hingedly attached both to said reinforcing panel and a side edge of said inner end panel, and having a diagonal score line extending from its inner corner adjacent both said reinforcing panel and said inner end panel, and its outer free corner opposite said inner corner.

28. The container of claim 25 in which said first closure panel is hingedly attached to said top panel by a score line along the side edge of said top panel and said closure panel is attached to said first side wall.

29. The container of claim 25 further comprising a third side panel between said first closure panel and said top panel and hingedly attached to both, and said first closure panel fastened to said bottom panel.

30. The container of claim 25 in which said reinforcing panels attached to said second side panels have oblique score lines extending across said reinforcing panel from the corner of said reinforcing panel formed by said central reinforcing section and said side wall.

31. The container of claim 25 in which said bottom end cell panel is separated from said bottom panel by a cut line.

32. The container of claim 31 further comprising end closure panels attached to said top panel, said end closure panels comprising an outer end panel hingedly attached to said top panel and extending between said top and bottom panels, and a second closure panel hingedly attached to the outer edge of said outer end panel and attached to said bottom panel.

33. The container of claim 32 in which bellows panels extend along the outer face of said inner end panels, and each of said bellows panels being hingedly attached both to said reinforcing panel and a side edge of said inner end panel, and having a diagonal score line extending from its inner corner adjacent both said reinforcing panel and said inner end panel, and its outer free corner opposite said inner corner.

34. The container of claim 31 in which said first closure panel is hingedly attached to said top panel by a score line along the side edge of said top panel and said closure panel is attached to said first side wall.

35. The container of claim 31 further comprising a third side panel between said first closure panel and said top panel and hingedly attached to both, and said first closure panel fastened to said bottom panel.

36. The container of claim 31 in which said reinforcing panels attached to said second side panels have oblique score lines extending across said reinforcing panel from the corner of said reinforcing panel formed by said central reinforcing section and said side wall.

37. The method of forming a book package comprising (a) providing a blank comprising:

a first side panel, a bottom panel, a second side panel, and a top panel hingedly attached to each other by score lines and a first closure panel hingedly attached to one of said first side panel and said top panel, bottom end members extending outwardly from end edges of said first and second side panels and said bottom panel, said bottom end members comprising reinforcing panels hingedly attached to said end edges of said first and second side panels, a central end section hingedly attached to said reinforcing members, said hinged attachment being score lines aligned with said score lines between said bottom panel, and said first and second side panels, said central end section being divided by transverse score lines into a bottom end cell panel having said hinged attachment with said reinforcing panels, an inner end panel hingedly attached to said bottom end cell panel, said inner end panel being separated from said reinforcing panels, and an upper end cell panel hingedly attached to said inner end panel;

(b) folding said bottom end members inwardly around their hinged attachments with said first and second side panels;

(c) bending said inner end panels upwardly around their hinged attachments with said bottom end cell panels;

(d) folding said upper end cell panels outwardly around their hinged attachments with said inner end panels until they overlie said reinforcing panels;

(e) folding said second side panel upwardly around its hinged attachment with said bottom panel;

(f) folding said top panel downwardly around its hinged attachments with said second side panel until it overlies and is parallel with said bottom panel;

(g) folding said first side panel upwardly around its hinged attachment with said bottom panel; and (h) folding said closure panel inwardly and fastening it to said container.

38. The method of claim 37 further comprising said blank further comprises end closure panels attached to said top panel, said end closure panels comprising an outer end panel hingedly atttached to said top panel, and a second closure panel hingedly attached to the outer edge of said outer end panel;

bending said outer end panels downwardly around their hinged attachment to said top panel; and bending said second closure panels inwardly around their hinged attachment to said outer end panels and fastening said outer end panels to said container.

39. The method of claim 37 further comprising said blank further comprises said first closure panel attached to said top panel by a score line along the side edge of said top panel; and bending said first closure panel downwardly around its hinged attachment with said top panel and fastening said first closure panel to said first side panel.

40. The method of claim 37 further comprising said blank further comprises a third side panel between said first cloure panel and said top panel and hingedly attached to both; and bending said third side panel downwardly around its hinged attachment with said top panel; and bending said first closure panel inwardly around its hinged attachment with said third side panel and fastening said first closure panel to said container.

41. The method of claim 37 further comprising said blank further comprises bellows panels hingedly attached both to said reinforcing panels and the side edges of said inner end panel, and said bellows panels each have a diagonal score line extending from an inner corner of said bellows panel formed by both said reinforcing panel and said inner end panel, and an outer free corner of said bottom panel opposite said inner corner; and bending said bellows panels inwardly to overlie said inner end panels when said first and second side walls are bent upwardly.

42. The method of claim 37 in which said bottom end cell panel of said blank is separated from said bottom panel by a cut line whereby the only attachment between said bottom end members and said first and second side panels and said bottom panel is by said score lines attaching said reinforcing panels to said first and second side panels.

43. The method of claim 42 further comprising said blank further comprises end closure panels attached to said top panel, said end closure panels comprising an outer end panel hingedly attached to said top panel, and a second closure panel hingedly attached to the outer edge of said outer end panel;

bending said outer end panels downwardly around their hinged attachment to said top panel; and bending said second closure panels inwardly around their hinged attachment to said outer end panels and fastening said outer end panels to said container.

44. The method of claim 42 further comprising said blank further comprises said first closure panel attached to said top panel by a score line along the side edge of said top panel; and bending said first closure panel downwardly around its hinged attachment with said top panel and fastening said first closure panel to said first side panel.

45. The method of claim 42 further comprising said blank further comprises a third side panel between said first closure panel and said top panel and hingedly attached to the both;

bending said third side panel downwardly around its hinged attachment with said top panel; and bending said first closure panel inwardly around its hinged attachment with said third side panel and fastening said first closure panel to said container.

46. The method of claim 42 further comprising said blank further comprises bellows panels hingedly attached both to said reinforcing panels and the side edges of said inner end panel, said bellows panels each having a diagonal score line extending from an inner corner of said bellows panel formed by both said reinforcing panel and said inner end panel, and an outer free corner of said bellows panel opposite said inner corner; and bending said bellows panels inwardly to overlie said inner end panels when said first and second side walls are bent upwardly.

* * * * *